US005936657A

United States Patent [19]

Fork

[11] Patent Number: 5,936,657

[45] Date of Patent: Aug. 10, 1999

[54] SELF REPLACING OLED MULTIBAR PRINTBAR

[75] Inventor: David K. Fork, Palo Alto, Calif.

[73] Assignee: Xerox Corporation, Stamford, Conn.

[21] Appl. No.: 08/785,231

[22] Filed: Jan. 17, 1997

[51] Int. Cl.[6] ..... B41J 2/235

[52] U.S. Cl. ..... 347/237; 347/43; 347/238

[58] Field of Search ..... 347/237, 238, 347/19, 239; 257/79, 40

[56] References Cited

U.S. PATENT DOCUMENTS

| | | | |
|---|---|---|---|
| 4,596,995 | 6/1986 | Yamakawa et al. | 347/237 |
| 5,043,743 | 8/1991 | Habets et al. | 347/239 |
| 5,124,720 | 6/1992 | Schantz | 347/19 |
| 5,198,803 | 3/1993 | Shie et al. | 345/82 |
| 5,517,151 | 5/1996 | Kubota | 347/238 |
| 5,668,587 | 9/1997 | Hammond et al. | 347/237 |
| 5,671,002 | 9/1997 | Murano | 347/237 |
| 5,693,956 | 12/1997 | Shi et al. | 257/40 |
| 5,719,589 | 2/1998 | Norman et al. | 345/82 |

*Primary Examiner*—N. Le
*Assistant Examiner*—Lamson Nguyen
*Attorney, Agent, or Firm*—Oliff & Berridge, PLC

[57] ABSTRACT

A fault-tolerant self-replacing xerographic light emitter array includes circuitry for operating an array of organic light emitting diodes (OLEDs). The light emitter array provides imaging from a single row of imagers which operate at high brightness and high current. The emitter area is extended by having multiple rows of emitters. When one or more of the pixels of a currently-selected row burns out or decays to a level insufficient for imaging, a new row is activated and imaging continues. This is possible because the emitter rows are closely spaced and share an optical lens wide enough to collect light with adequate throughput for all rows. This redundancy permits imaging to continue without adjusting or replacing any mechanical parts of the emitter array. In addition, because of the fault-tolerant design, a single bad row or pixel does not render the device unusable. This technique is applicable to a variety of emitters or light valves, but is particularly suited to inexpensive OLEDs. The fault-tolerant active matrix xerographic light emitter array extends the lifetime of a single row printbar by the number of rows of emitters.

28 Claims, 2 Drawing Sheets

SELF REPLACING OLED MULTIBAR PRINTBAR

BACKGROUND OF THE INVENTION

1. Field of the Invention

This invention relates to xerographic imagers using a light emitter array. In particular, this invention is directed to architectures, characteristics and methods of using a fault-tolerant multibar arrangement for organic light emitting diode (OLED) printbars used in such xerographic light emitter arrays.

2. Technical Background

One of the fundamental design challenges for xerographic imaging is getting enough light to the photoreceptor at sufficient print speed while providing adequate service lifetime of the printbar. Rapid progress in OLEDs has produced devices which emit light levels greater than computer monitors (300 cd/m$^2$) and fluorescent tubes (3000 cd/m$^2$) in both white and in colors collectively spanning the visible spectrum.

Lifetime studies of OLEDs indicate that diode lifetime is determined by the total charge passed through the OLED. Thus the OLEDs operate for short times at high brightness or for long times at low brightness. The lower end of the OLED brightness range is most stable, generally sustaining lifetimes of greater than 10,000 hours. The higher end of the OLED brightness range is less stable. For example, OLED devices operating at 1500 cd/m$^2$ currently have sustainable lifetimes of only about 500 hours.

In a one-dimensional page-width array of such OLEDs there is not enough brightness to print at a reasonable speed with reasonable reliability for commercial uses. Table 1 outlines the technical data for a xerographic printer using a single row OLED printbar having OLED emitters operating at 1500 cd/m$^2$. The printbar is illuminating a photoreceptor requiring about 7.5 ergs/cm$^2$. Thus, the print-speed of the single row device is about 0.29 pages/min. Moderate print-speeds are above five pages/min, and a more desirable print speed is about 30 pages per minute. The brightness deficit determined by this rough calculation is about 100×, especially when considering that the print speed calculation for the single row page-width array of OLEDs leaves no room for dead time. In addition, inorganic diode based printbars typically have a duty cycle well under 50% in part to minimize blur in the process direction. Furthermore, the calculated print-speed is the speed before degradation, where the lifetime for the devices is the time to 50% output decay.

TABLE 1

TECHNICAL DATA FOR A CONVENTIONAL SINGLE ROW OLED PRINTBAR

| Light Emitter Inputs | | | Outputs | | |
|---|---|---|---|---|---|
| Average Wavelength | 590 | nm | Surface Luminous Flux | 0.4712 | 1 m/cm$^2$ |
| Avg. Luminous Efficacy | 450 | 1 m/W | Surface Radiance | 0.0010 | W/cm$^2$ |
| LED Brightness | 1500 | cd/m$^2$ | Surface Radiance | 10472.0 | ergs/sec.cm$^2$ |
| LED Current Density | 25 | mA/cm$^2$ | Photoreceptor Irradiance | 103.778 | ergs/sec.cm$^2$ |
| Display Voltage | 20 | Volts | Pixel Size | 0.0085 | cm |
| Number of Rows | | | Pixel Current | 1.79 | uA |
| Array Fill Factor | 88% | | Array Emitting Area | 0.26 | cm$^2$ |
| Optical Inputs | | | Array Width | 0.08 | mm |
| Lens Transmittance | 90% | | Array Emission | 27.50 | ergs/sec |
| Lens Effective F# | 4.765 | | Array Current | 6.623643 | mA |
| Lens Efficiency | 1.0% | | Array (Max) Power | 0.13 | Watts |
| Photoreceptor Dose | 7.5 | erg/cm$^2$ | Power Efficiency | 0.2094% | |
| Page Property Inputs$^2$ | | | Page Dose | 5758.05 | ergs |
| Document exc. Time | 0 | sec | Page Time | 209.42 | sec |
| Fast scan resolution | 300 | in$^{-1}$ | Line Time | 82.12 | msec |
| Slow scan resolution | 300 | in$^{-1}$ | Print Speed | 0.287 | pages/min |
| Fast scan length | 14 | in | Data Rate | 0.051 | MHz |
| Slow scan length | 8.5 | in | | | |
| Fractional line Time | 100% | | | | |

The brightness deficit of currently available OLED devices is too large to compensate simply by running the diodes harder. For example, operating the OLEDs even briefly at 15000 cd/m$^2$ would require such a high bias that the OLEDs would quickly become inoperative. Furthermore, doing so would only increase the print speed of the single row array to 3 pages/minute. In addition, the total lifetime print volume of the xerographic imager (<9,000 pages) is insufficient.

Commonly assigned U.S. patent application Ser. No. 08/785,230 to Fork, filed concurrently herewith, entitled "Integrating Xerographic Light Emitter Array," the disclosure of which is incorporated herein by reference in its entirety, discloses one approach for using OLEDs operated at modest light levels to expose a photoreceptor drum or belt. This is accomplished by staging an array of emitters in the slow scan direction, and clocking the data through pixel driving shift-registers synchronized with the movement of photoreceptor past the array in the slow scan direction. Increased emitter lifetime and the ability to operate at lower light levels are achieved in proportion to the number of stages.

Commonly assigned U.S. patent application Ser. No. 08/785,233 to Fork et al., filed concurrently herewith, entitled "Integrating Xerographic Light Emitter Array with Grey Scale," the disclosure of which is incorporated herein by reference in its entirety, discloses another approach for using OLEDs operated at modest light levels to expose a photoreceptor drum or belt. This is accomplished by staging rows of emitters in the slow scan direction and moving the object image down the rows synchronously with the movement of the photoreceptor past the array in the slow scan direction in a manner similar to U.S. patent application Ser. No. 08/785,230. However, the entire printbar can be rewritten during each line time of the photoreceptor, which allows the exposure on any spot on the photoreceptor to be varied over a number of grey levels equal to the number of stages.

SUMMARY OF THE INVENTION

This invention provides a fault tolerant active matrix xerographic light emitter array. This invention also provides a method for operating a fault tolerant xerographic light emitter array.

The array includes pixels arranged in columns and rows, with each pixel having a light emitter, and a control device that activates a selected row of the pixels and deactivates all of the other rows of the is pixels. When the selected row of pixels becomes inoperative, the control device deactivates the now-inoperative selected row of pixels and activates a different operable row of the pixels as the selected row. Data drivers transmit light emission signals to the pixels located in the selected row. Each light emitter may be an OLED.

The control device of the multibar xerographic light emitter array may be a row select multiplexer that deactivates rows by placing them in a high impedance state. Each pixel includes an anode and a cathode, either or both of which may be shared in common with adjacent pixels in a row or column. Organic emitting material may be deposited over the anode or the cathode, with the other of the anode or cathode deposited over the organic emitting material.

In addition, the data drivers may be at least one data multiplexer. The value of every light emission signal may be modified between successive frame periods, where a frame period is defined as the time required for the photoreceptor to move by one spot diameter. The multibar xerographic light emitter array may also include a drive transistor in each pixel, with the transistor being a thin film transistor (TFT) made of polysilicon, amorphous silicon or cadmium selenide. The transistor may also be made of single crystal silicon.

The method includes arranging pixels into rows and columns, deactivating all the rows of the array except for one selected row, transmitting light emission signals to the pixels located in the selected row and providing a light beam from a light emitter located in each pixel of the selected row. When the selected row becomes inoperative, the control device deactivates the now-inoperative selected row, activates a different operable row as the selected row, and continues operation.

A more complete understanding of this invention can be obtained by considering the following detailed description in conjunction with the accompanying drawings.

BRIEF DESCRIPTION OF THE DRAWINGS

The invention is illustrated in the accompanying drawings, wherein like index numerals indicate like parts, in which.

DETAILED DESCRIPTION OF THE PREFERRED EMBODIMENTS

As described in detail below, this invention provides a way to extend the lifetime of an OLED xerographic printbar by creating a plurality of single row printbars on a substrate and selecting a working single row printbar when a currently-selected row of the printbar fails. All the single-row printbars share common optics.

Imaging is done from a single row of emitters. The emitters of the selected or operated row may operate at higher brightness and higher current than the integrating xerographic light emitter array and the integrating xerographic light emitter array with grey scale discussed above.

The emitter area is extended by having multiple rows of emitters. When one or more emitters of a currently-selected row of emitters burns out or decays to a level insufficient for printing, the currently-selected row of emitters is deactivated. A new row of emitters is activated and printing continues. This is possible because the emitter rows are closely spaced and share a lens wide enough to collect light with adequate throughput for all rows. This technique is applicable to a variety of emitters or light valves, but is particularly suited to inexpensive OLEDs which are known to degrade in proportion to the charged passed through them.

This invention uses redundancy to extend the printbar lifetime and to improve the fault tolerance and therefore the yield of the device. The redundancy permits printing to be restored without adjusting or replacing any mechanical parts.

Figure 1:
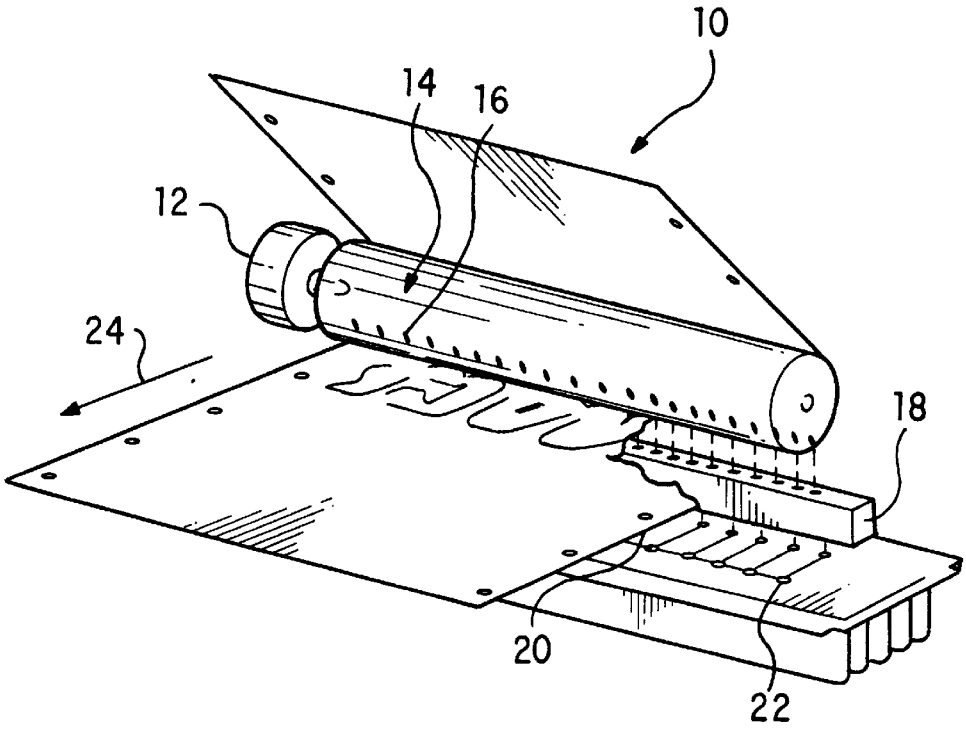
FIG. 1 is a schematic view of an exposure system of an imaging subsystem of a xerographic printer.

FIG. 1 schematically shows an exposure system 10 for a LED array 20 in accordance with this invention. The exposure system 10 includes a position encoder 12, a photoreceptor 14, an imaged line 16, a lens array 18, a LED array 20 and control electronics 22. As discussed above, since the emitter rows of the LED array 20 are closely spaced, they share the lens array 18, which is wide enough to collect light from all the emitter rows.

Figure 2:
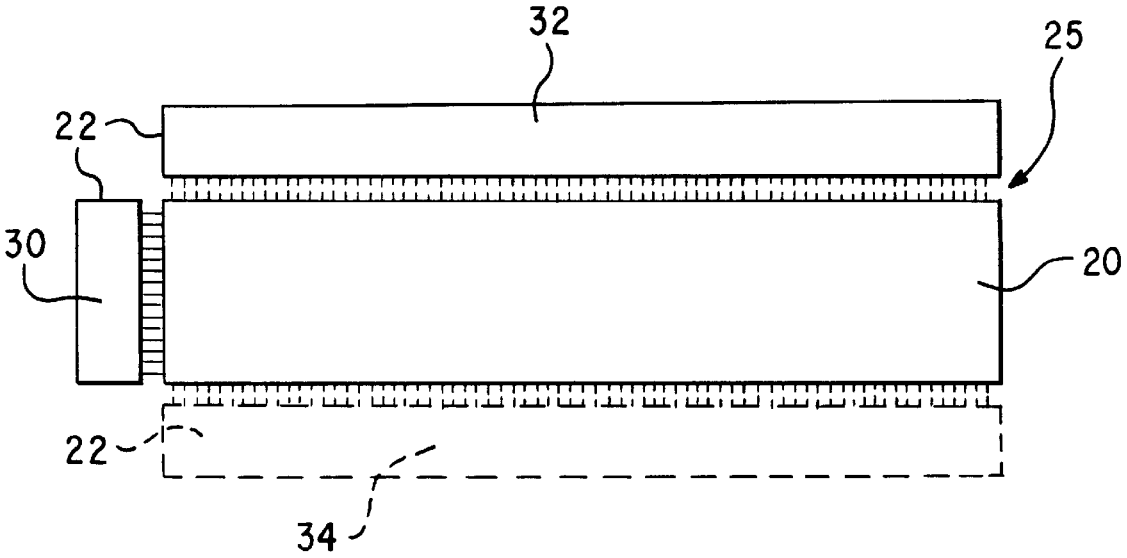
FIG. 2 is a schematic view of a printbar in accordance with a preferred embodiment of the invention.

FIG. 2 schematically illustrates a printbar 25 in accordance with a preferred embodiment of this invention. The printbar 25 includes the LED array 20, a multiplexer 30 and a plurality of data line drivers 32. The LED array 20, for example, includes 64 rows of pixels extending in the direction of rotation of the photoreceptor 14, and 4200 columns of pixels extending along an axis of rotation of the photoreceptor 14. This forms a 14-inch-wide printbar having 300 spots per inch (SPI).

The data line drivers 32 can drive the LED array 20 with as many levels of grey as the driver electronics permit. In this example, the data line drivers 32 feed the anode side of the diodes and the mulitplexer 30 feeds the cathode side of the diodes. Thus, in FIG. 2, the anodes are common to all columns and the cathodes are common to all rows. However, the polarities can be reversed.

The multiplexer 30 places all rows except the currently-selected row into a high impedance state. Thus, light is emitted only from the single row not placed in the high impedance state. The multiplexer 30 may be implemented with monolithic polysilicon with bonded connections to silicon electronics, or any known technique for integrating circuits into a substrate.

Determination of when the degraded condition of the row requires selecting an alternate row may be done in a variety of ways. For example, a photodiode could directly monitor the bar periodically to assess decay. Alternately, the photoreceptor charge before and after exposure could be monitored with an electrostatic voltmeter. Another approach is to set a preprogrammed operational life period to determine the replacement interval. Many other approaches are also possible, and are commonly used in the repair and monitoring of xerographic engines.

Figure 3:
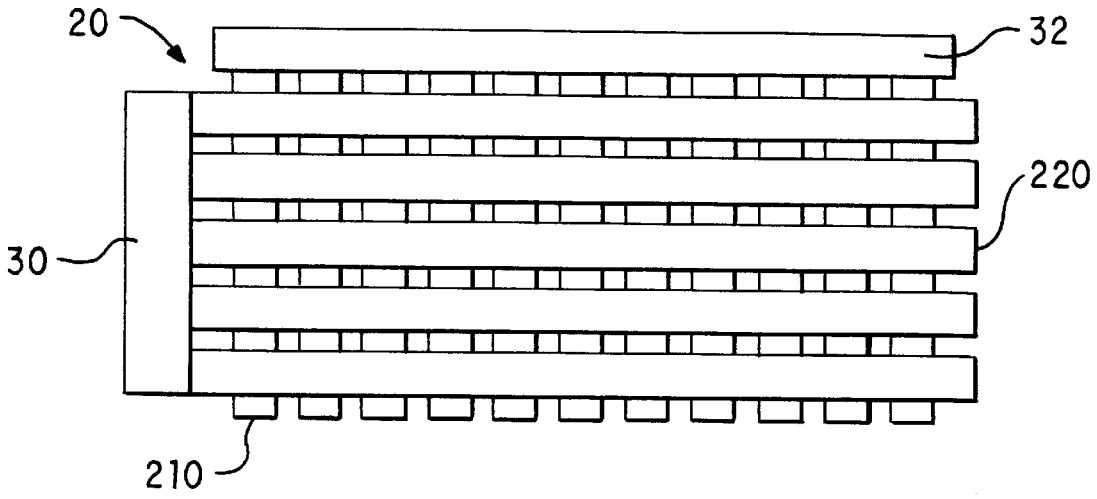
FIG. 3 is a schematic illustration of pattern anode and cathode electrodes of the printbar in accordance with a first preferred embodiment of the invention.

FIG. 3 shows an illustration of a portion of the active matrix LED array 20 in accordance with a first preferred embodiment of the invention. This embodiment includes the multiplexer 30 and the data line drivers 32 of FIG. 2, and patterned anode electrodes 210 and patterned cathode electrodes 220 crossing at 90 degrees. In this embodiment, no transistors are required within the emitting areas of the array 20. Either the cathode electrode layer or the anode electrode layer can be formed first and patterned to form either the cathode electrodes 220 or the anode electrodes 210, respectively. The organic emitting material is then deposited over the patterned set of either the cathode electrodes 220 or the anode electrodes 210. Subsequently, the other of the cathode electrode layer and the anode layer is deposited over the organic emitting material and patterned to form the other of the cathode electrodes 220 or the anode electrodes 210. An example patterning technique uses a higher resolution stencil mask for the top cathode electrodes 220 or anode electrodes 210. Only a coarse evaporation aperture is needed for the organic layers.

Figure 4:
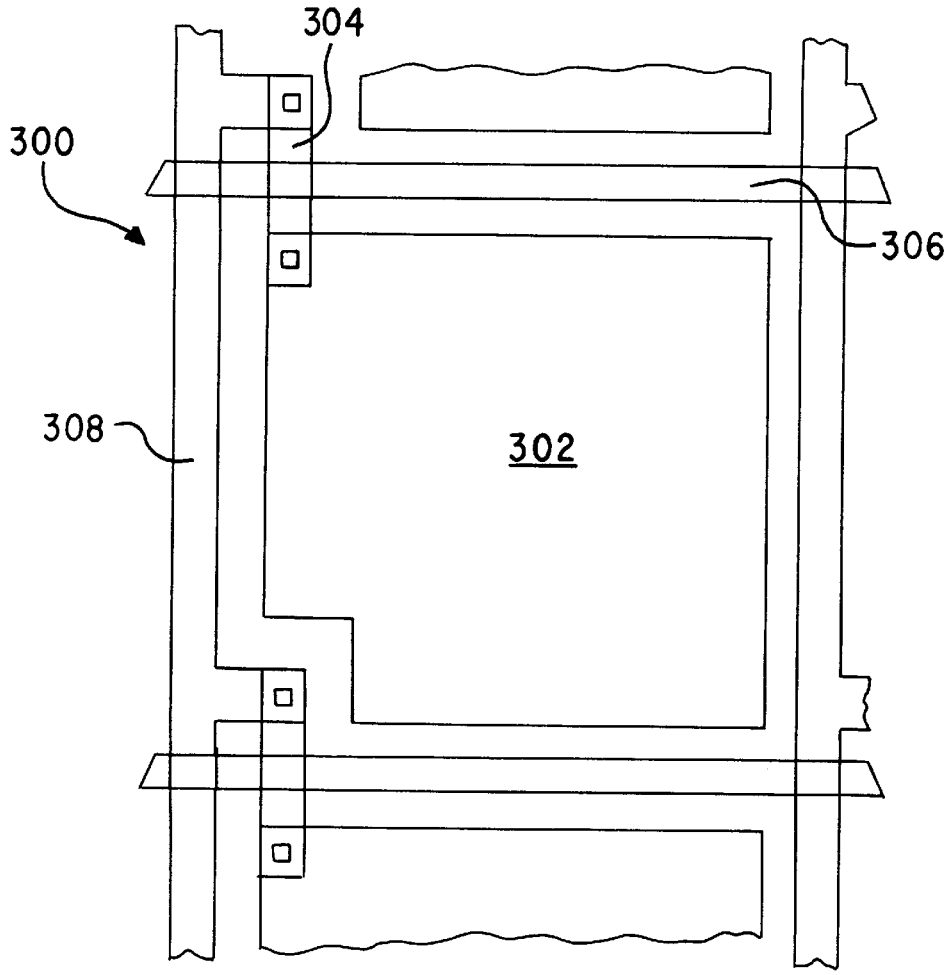
FIG. 4 is a preferred schematic view of a common electrode layout for an individual pixel of a printbar in accordance with a second preferred embodiment of the invention.

FIG. 4 illustrates a second preferred embodiment of this invention using a common anode or common cathode configuration. Each pixel 300 of the array 20 includes a bottom electrode 302 of the diode, which is either the anode or the cathode, a drive TFT 304, a row enable line 306 and a data line 308. The drain of the drive TFT 304 is connected to the data line 308. The source of the drive TFT 304 is connected to the bottom electrode 302 of the diode. The row enable line 306 is made of, for example, gate polysilicon and is connected to the gate of the drive TFT 304 of each pixel 300 in a row of the array 20. Thus, all the gates in a row are simultaneously turned on and off. Therefore, the gate voltage on the row enable line 306 controllably turns on or off the diodes of the corresponding row of the array. However, none of the other rows of the array are controlled by this row enable line 306.

The required pixel current is less than 10A and is sufficiently low that it can be provided by, for example, a small polysilicon TFT. The row enable lines 306 are, for example, gate polysilicon. A gate shunt (not shown) can increase conductance, but may be unnecessary because the row enable line is not switched rapidly. The data lines 308 are, for example, metal.

A storage capacitor is generally not needed to supply constant current to the OLED because only a single row is used at a time for imaging. For this reason, the data lines are excited during an entire line time. Thus, the pixel level circuitry can be manufactured efficiently with only a single drive TFT 304 per pixel, with no sample and hold circuitry needed. This removes concerns about leakage current, which is the most sensitive property for polysilicon TFTs. The TFTs may be made from polysilicon, amorphous silicon or cadmium selenide. In addition, single crystal silicon drive transistors and their equivalents may be used in lieu of drive TFTs.

In this embodiment, the state properties of the pixels are important only when the rows are "on". Rows are either always on or always off. In other words, a row is not repeatedly switched on and off during operation, but is continually on when it is operated.

In this second preferred embodiment, the top electrode and the organic materials are not illustrated. The top electrode, which is the other of the anode and the cathode, is a continuous layer deposited over the organic layers and is thus common to all pixels on the array. The pixels are isolated from each other by the high spreading resistance of the organic materials. The pixels are thus defined by the bottom electrode.

In this embodiment, the active area of the diode 302 does not overlap the drive TFT 304, the row enable line 306 or the data lines 308. To achieve a higher fill factor, the area of the pixel diode can be expanded to overlap these areas. This is particularly effective for top emitting pixels which use, for example, a transparent indium-tin-oxide anode. Top emitting pixels additionally eliminate source degeneration in NMOS architectures since, in such a common anode design, the data lines define the low voltage side of the TFT channel.

During normal operation, only one gate enable line 306 is enabled. The other gate enable lines 306 of the array are disabled and are only enabled to activate a new row after one or more of the pixels of a currently-selected row has failed or degraded to a nonfunctional level.

For either embodiment, a dielectric layer stack may be used to achieve directed emission by creating a microcavity structure as is commonly known. Doing so will increase the throughput of the relay lens, allowing an overall increase in the printspeed of the device. This dielectric layer stack can be deposited either before or after the TFT/LED fabrication stages, or both. If a high temperature process (i.e., a process performed at greater than 150° C.) is required, it may be preferable to deposit the dielectric layer stack before the other layers. However, low temperature deposition of organic layers could be used to form the stack, increasing design flexibility.

The technical data for a fault tolerant xerographic light emitter array is illustrated in Table 2, wherein a brightness of 10000 cd/m$^2$ was chosen at 580 nm for operating a device having a lifetime of 15000 mA-hr/cm$^2$. Sixty-four rows of LED elements were used in each column for a photoreceptor requiring 2 ergs/cm$^2$ dose. This makes the emitter width about 5 mm at 300 SPI. The lens efficiency is about 1%.

A 14-inch-wide print drum or belt was assumed, leading to a device area with a current draw and power consumption of 27 mA and 400 mW respectively, which is well within the capacity of chip bonded multiplexing silicon electronics. A large polysilicon device may also be suited for a row select multiplexer.

TABLE 2

TECHNICAL DATA FOR A 300 dpi OLED EMITTER ARRAY OPERATED IN ACCORDANCE WITH THE FIRST PREFERRED EMBODIMENT OF THE INVENTION

| Light Emitter Inputs | | Outputs | |
|---|---|---|---|
| Wavelength | 633 nm | Surface Luminous Flux | 3.1416 1 m/cm$^2$ |
| Luminous Efficacy | 594 1 m/W | Surface Radiance | 0.0053 W/cm$^2$ |

TABLE 2-continued

TECHNICAL DATA FOR A 300 dpi OLED EMITTER ARRAY OPERATED IN ACCORDANCE WITH THE FIRST PREFERRED EMBODIMENT OF THE INVENTION

| Light Emitter Inputs | | | Outputs | | |
|---|---|---|---|---|---|
| LED Brightness | 10000 | $cd/m^2$ | Surface Radiance | 52888.8 | $ergs/sec.cm^2$ |
| LED Current Density | 100 | $mA/cm^2$ | Photoreceptor Irradiance | 524.129 | $ergs/sec.cm^2$ |
| Display Voltage | 15 | Volts | Array Width | 4200 | pixels |
| Number of Rows | 64 | | Pixel Size | 0.0085 | cm |
| Array Fill Factor | 90% | | Pixel Current | 7.17 | uA |
| LED Lifetime | 15000 | $mAh/cm^2$ | Array Emitting Area | 0.27 | $cm^2$ |
| Optical Inputs | | | Array Height | 5.42 | mm |
| Lens Transmittance | 90% | | Array Emission | 142.02 | ergs/sec |
| Lens Effective F# | 4.765 | | Array Current | 27.1 | mA |
| Lens Efficiency | 1.0% | | Array (Max) Power | 0.41 | Watts |
| Photoreceptor Dose | 2 | $erg/cm^2$ | Quantum Efficiency | 0.3526% | |
| Page Property Inputs | | | Page Dose | 1535.48 | ergs |
| Document exc. Time | 0 | sec | Page Time | 10.81 | sec |
| Fast scan resolution | 300 | $in^{-1}$ | Line Time | 4.24 | msec |
| Slow scan resolution | 300 | $in^{-1}$ | Print Speed | 5.55 | pages/min |
| Fast scan length | 14 | in | Data Rate | 0.99 | MHz |
| Slow scan length | 8.5 | in | Data Line Rate | 0.24 | KHz |
| Fractional line Time | 100% | | Row Print Volume | 49946 | pages |
| | | | Bar Print Volume | 3196572 | pages |

The LED bar consumes less than 1 watt and prints at 5.5 pages per minute. The data drivers may be wire bonded, tab bonded or the like to the silicon circuitry or the monolithically integrated data multiplexers. The total data rate is about 1 MHz, which is within limits of either single or multi-tap data multiplexers. Due to the density of connections required to address a 300 SPI or greater resolution printbar, multiplexers of some type may be required, since this is close to the tab bonding density limit. The pixel current is 7.17 microamps.

Since the print volume for a row of pixels is about 50,000 pages, the print volume for a 64 row bar is about 3.2 million pages. This represents a significant improvement in the service lifetime of a printbar in accordance with the invention.

While this invention is described in detail herein with specific reference to certain illustrative embodiments, it is to be understood that there is no intent to be limited to these embodiments. On the contrary, the aim is to cover all modifications, alternatives, and equivalents falling within the spirit and scope of the invention as defined by the following claims. For example, the invention is applicable to all types of imaging devices that use light beams to form images. Such imaging devices include facsimile machines, copiers, printers, etc.

What is claimed is:

1. A fault-tolerant multibar xerographic light emitter array, comprising:

a plurality of pixels arranged in a plurality of rows and a plurality of columns;

a control device connected to the plurality of row that actuates a currently-selected row of the plurality of rows and deactivates all other rows of the plurality of rows to perform single row imaging with the currently-selected row, wherein when the currently-selected row becomes inoperative, the control device deactivates the currently-selected row and activates another operable one of the plurality of rows as the currently-selected row; and a plurality of data drivers transmitting a plurality of light emission signals to the plurality of pixels located in the currently-selected row, respectively.

2. The fault-tolerant multibar xerographic light emitter array of claim 1, further comprising a plurality of light emitters, one light emitter provided in each of the plurality of pixels and outputting a light beam modulated according to the corresponding light emission signal.

3. The fault-tolerant multibar xerographic light emitter array of claim 2, wherein each light emitter is an OLED.

4. The fault-tolerant multibar xerographic light emitter array of claim 3, wherein the control device is a row select multiplexer that places the deactivated ones of the plurality of rows in a high impedance state.

5. The fault-tolerant multibar xerographic light emitter array of claim 3, further comprising at least one data multiplexer, wherein the plurality of data drivers is arranged into the at least one data multiplexer.

6. The fault-tolerant multibar xerographic light emitter array of claim 3, wherein each of the plurality of rows includes one of a common anode and a common cathode and each of the plurality of columns includes another one of the common cathode and the common anode.

7. The fault-tolerant multibar xerographic light emitter array of claim 6, further comprising organic emitting material deposited over one of the common anode and the common cathode, the other of the common anode and the common cathode deposited over the organic emitting material.

8. The fault-tolerant multibar xerographic light emitter array of claim 3, wherein each of the plurality of pixels includes an anode and a cathode, wherein at least one of the anode and the cathode is shared in common with adjacent pixels in one of the plurality of rows and the plurality of columns.

9. The fault-tolerant multibar xerographic light emitter array of claim 8, wherein each of the plurality of pixels further comprises a drive transistor.

10. The fault-tolerant multibar xerographic light emitter array of claim 9, wherein the drive transistor is a drive thin film transistor.

11. The fault-tolerant multibar xerographic light emitter array of claim 10, wherein the drive thin film transistor is made from one of at least polysilicon, amorphous silicon and cadmium selenide.

12. The fault-tolerant multibar xerographic light emitter array of claim 9, wherein the drive transistor is a single crystal silicon drive transistor.

13. The fault-tolerant multibar xerographic light emitter array of claim 1, wherein each of the plurality of light emission signals has a value modifiable between successive frame periods.

14. A method for operating a fault-tolerant multibar xerographic light emitter array, comprising:

providing a plurality of pixels arranged in a plurality of rows and a plurality of columns, each pixel including a light emitter;

activating a currently-selected one of the plurality of rows with a control device connected to the plurality of rows to perform single row imaging with the currently-selected row;

deactivating all other ones of the plurality of rows with the control device;

transmitting a plurality of light emission signals via a plurality of data drivers to the plurality of pixels located in the currently-selected row, respectively;

determining if the currently-selected row has become inoperative; and when the currently-selected row has become inoperative, deactivating the currently-selected row and activating a different operable one of the plurality of rows with the control device as the currently-selected row.

15. The method of claim 14, further comprising providing, from each of the plurality of pixels located in the currently-selected row, a light beam from the light emitter of that pixel in accordance with a corresponding one of the plurality of light emission signals.

16. The method of claim 14, wherein each of the plurality of light emitters is an OLED.

17. The method of claim 15, further comprising placing the deactivated rows in a high impedance state.

18. The method of claim 16, wherein the control device is a row-select multiplexer.

19. The method of claim 15, wherein the fault tolerant multibar xerographic light emitter array includes at least one data multiplexer, further comprising arranging the plurality of data drivers into the at least one data multiplexer.

20. The method of claim 15, wherein each of the plurality of rows includes one of a common anode and a common cathode and each of the plurality of columns includes another one of the common cathode and the common anode.

21. The method of claim 20, further comprising:

depositing organic emitting material over the one of the common anode and the common cathode; and depositing the other of the common anode; and the common cathode over the organic emitting material.

22. The method of claim 15, further comprising providing, in each of the plurality of pixels, an anode and a cathode, wherein at least one of the anode and the cathode is shared in common with adjacent pixels in one of the plurality of rows and the plurality of columns.

23. The method of claim 22, further comprising providing a drive transistor in each of the plurality of pixels.

24. The method of claim 23, wherein the drive transistor is a drive thin film transistor.

25. The method of claim 24, further comprising making the drive thin film transistor from one of at least polysilicon, amorphous silicon and cadmium selenide.

26. The method of claim 23, further comprising making the drive transistor from at least a single crystal silicon.

27. The method of claim 14, further comprising modifying a value of any of the plurality of light emission signals between frame periods.

28. The method of claim 14, wherein the determining step comprises at least one of:

determining if at least one of the pixels of the currently-selected row has become inoperative; and determining if an operation of at least one of the pixels of the currently-selected row has degraded below a predetermined performance threshold.

* * * * *